United States Patent [19]

Schlund

[11] Patent Number: 4,749,014

[45] Date of Patent: Jun. 7, 1988

[54] CUTTERHEAD FOR A POWER PLANER

[75] Inventor: Gerald Schlund, Weisbaden, Fed. Rep. of Germany

[73] Assignee: Black & Decker Inc., Newark, Del.

[21] Appl. No.: 62,773

[22] Filed: Jun. 15, 1987

[30] Foreign Application Priority Data

Jun. 26, 1986 [DE] Fed. Rep. of Germany ..... 3621359

[51] Int. Cl.[4] ..... B27C 1/10; B27G 13/04

[52] U.S. Cl. ..... 144/225; 30/475; 144/117 C

[58] Field of Search ..... 407/89, 90, 113, 115; 144/230, 117 R, 117 C, 131, 218, 225; 30/475

[56] References Cited

U.S. PATENT DOCUMENTS

| | | | |
|---|---|---|---|
| 1,397,014 | 11/1921 | Oliver | 144/225 |
| 4,066,111 | 1/1978 | Klebe | 144/225 |
| 4,280,542 | 7/1981 | Alessio et al. | 144/230 |
| 4,347,882 | 9/1982 | Bachmann | 144/225 |
| 4,382,729 | 5/1983 | Bachmann | 144/117 C |

FOREIGN PATENT DOCUMENTS 3318820 12/1984 Fed. Rep. of Germany .

*Primary Examiner*—W. Donald Bray

*Attorney, Agent, or Firm*—Edward D. Murphy; Harold Weinstein; Edward D. C. Bartlett

[57] ABSTRACT

A cutterhead for a power planer has an elongated core with threaded holes for releasably mounting a pressure plate with a cutting blade being clamped between the pressure plate and the core. The core has a support surface contacted by the cover portion, a contact surface contacted by the pressure plate, and a transition surface therebetween. The support surface is inclined to the contact surface at a angle of more than 180 degrees and less than 270 degrees. This arrangement helps compensate for tolerances associated with the securing screws, and reduces any tendency for imbalance in the cutterhead when rotating. A pair of cover portions may support opposite sides of the cutting blade adjacent its cutting edge. The cutting blade may be a profile blade.

17 Claims, 5 Drawing Sheets

CUTTERHEAD FOR A POWER PLANER

FIELD OF THE INVENTION

The invention relates to cutterheads for power planers, particularly electrically powered portable planers.

BACKGROUND OF THE INVENTION

In a prior cutterhead disclosed in U.S. Pat. No. 4,347,882, the core of the cutterhead has a substantially rectangular cross-section, but the contact surface for the pressure plate is raised somewhat with respect to the support surface for the cover portion and is parallel thereto. The pressure plate is pressed onto the support surface by means of screws screwed centrally into the core. The pressure plate together with its free end and an adjacent surface running parallel to the contact surface for the pressure plate forms a slot. The cutting blade is inserted in this slot so that it is positioned in the desired position by positioning ribs and is secured by the clamping force exerted by the pressure plate. However, on loosening the screws securing the pressure plate, the blade can be drawn out of the slot in the axial direction of the cutterhead, or can be inserted in the slot. The arcuate cover portion rests with its one axially directed end face on the support surface of the core and with its other, radially directed end face on the radial outer end of the pressure plate. With the screws screwed into the core, the cover portion is pressed against said core and in this way is held in position. As cutting blades are provided on diagonally facing sides of the core, this leads to a cross-section of the cutterhead formed from core, pressure plates and cover portions, which is substantially circular and only has axially directed grooves in the vicinity of the projecting length of the cutting blade over the circumference of the circular cross-section.

In the case of the above cutterhead, manufacture and assembly without out-of-balance occurring can be difficult, because as a result of the unavoidable tolerances of the screws and particularly the screws used for fixing the covers, it is not always possible to achieve a precise positioning of the covers on the core. However, if the covers are not held precisely in the correct position with respect to the core, there is a change to the mass distribution with respect to the rotational axis of the core, and consequently to the cutterhead, so that an unbalanced condition occurs.

SUMMARY OF THE INVENTION

An object of the present invention is to provide an improved construction for a cutterhead for a power planer.

Another object of the invention is to provide a construction of a cutterhead for a power planer such that any influence of screw tolerances in creating an unbalanced condition is reduced.

According to the present invention there is provided a cutterhead for a power planer comprising an elongated core with threaded holes therein, at least one pressure plate releasably mounted on the core with a cutting blade clamped between the core and the pressure plate, and at least one cover portion releasably secured by screws to the core, the cover portion being supported by the core and covering the pressure plate. A support surface for the cover portion and a contact surface for the pressure plate are provided on the core. The support surface is inclined with respect to the contact surface at an angle of more than 180 degrees and less than 270 degrees.

This angle may be in the range of 200 to 250 degrees, for example 225 degrees.

Through inclining the support surface and contact surface for the pressure plate, it is ensured that on mounting, the cover portion is supported at one side on a surface extending parallel to the pressure plate contact surface and at the other side on the support surface at an angle thereto. Thus, when the securing screws are inserted and tightened, automatic alignment is obtained, which substantially compensates the imprecisions due to screw tolerances. This reduces any tendency for an out-of-balance condition occurring when the assembled cutterhead is rotated in use.

In order to obtain from the pressure force on the cover portion produced by the screw force components which are perpendicular to the contact surfaces for the cover portion, the threaded holes for fixing the cover portion can be at an angle with respect to the contact surface for the pressure plate. This angle is smaller than, and preferably roughly half as large as, the angle between the contact surface and the support surface for the cover portion.

The risk of an unbalanced condition can be further reduced by having the longitudinal axes of the threaded bores for fixing the cover portion intersect the middle axis of the core.

Preferably, the core has on diagonally outwardly facing sides centrosymmetrical arrangements of threaded holes, contact surfaces for pressure plates and support surfaces for cover portions. Then, on fitting two cutting blades, two pressure plates and two associated cover portions, a centrosymmetrical construction is obtained in which imbalances are substantially avoided.

In the case of such a symmetrical construction, the cover portions can surround the core and can support a cutting blade between their facing, radially outer surfaces running axially of the core.

In this arrangement, the support surfaces serve to position the cover portions with respect to the core, and the cover portions form a cutterhead whose diameter is larger than the maximum core diameter. This makes it possible to use cutting blades which project further outwardly with their inner end regions held in a conventional manner by means of the associated pressure or clamping plate, but with these blades being additionally supported by the cover portions adjacent to the cutting edges.

It is possible in the case of such a construction to form the cutting blades as profile cutting blades, the cover portions then being shaped in their areas adjacent to the cutting blades in accordance with the profile of the profile cutting blades.

Such a cutterhead makes it possible in a very simple manner, namely by merely replacing the profile cutting blades and the associated cover portions by other profile cutting blades with associated cover portions, to produce different profiles by means of the cutterhead when inserted in the planer.

It is pointed out in this connection that known cutterheads used for power planers and equipped with profile cutting blades (see for example German Patent Publication No. 3318820) have a very complicated construction. This is because the core not only carries the cutting blades and pressure plates, together with the cover portions, but also requires additional adjusting means for the profile cutting blades. In addition, both the pressure plates and the core have a complicated construction, and the core can only be manufactured as a result of extensive metal-removing machining operations.

In order to be able to use the cutterhead both as a cutterhead for planing and as a cutterhead with different profile cutting blades, it is possible to provide a power planer with a front and a rear shoe plate, between which there is a slot for the passage of a portion of the cutterhead, so that these shoe plates are detachably secured. Thus, the shoe plates can be interchanged for adapting to different cutterheads, so that the necessary safety clearance between the boundary edges of the slot and the circumference of the cutterhead are obtained, particularly with differently profiled cutting blades. If a cutterhead with profile cutting blades is to be used in such a planer, use is made of shoe plates, whose edges defining the slot are shaped in accordance with the profile of the profile cutting blades.

Other objects, features and advantages of the present invention will become more fully apparent from the following detailed description of the preferred embodiments, the appended claims and the accompanying drawings.

DETAILED DESCRIPTION OF THE PREFERRED EMBODIMENTS

Four embodiments of the cutterhead are illustrated. One embodiment is shown in FIGS. 1 and 6 to 9; another embodiment in FIGS. 2A and 3 to 5 with a variation of this embodiment in FIG. 2B; and a further embodiment in FIG. 10.

Figure 1:
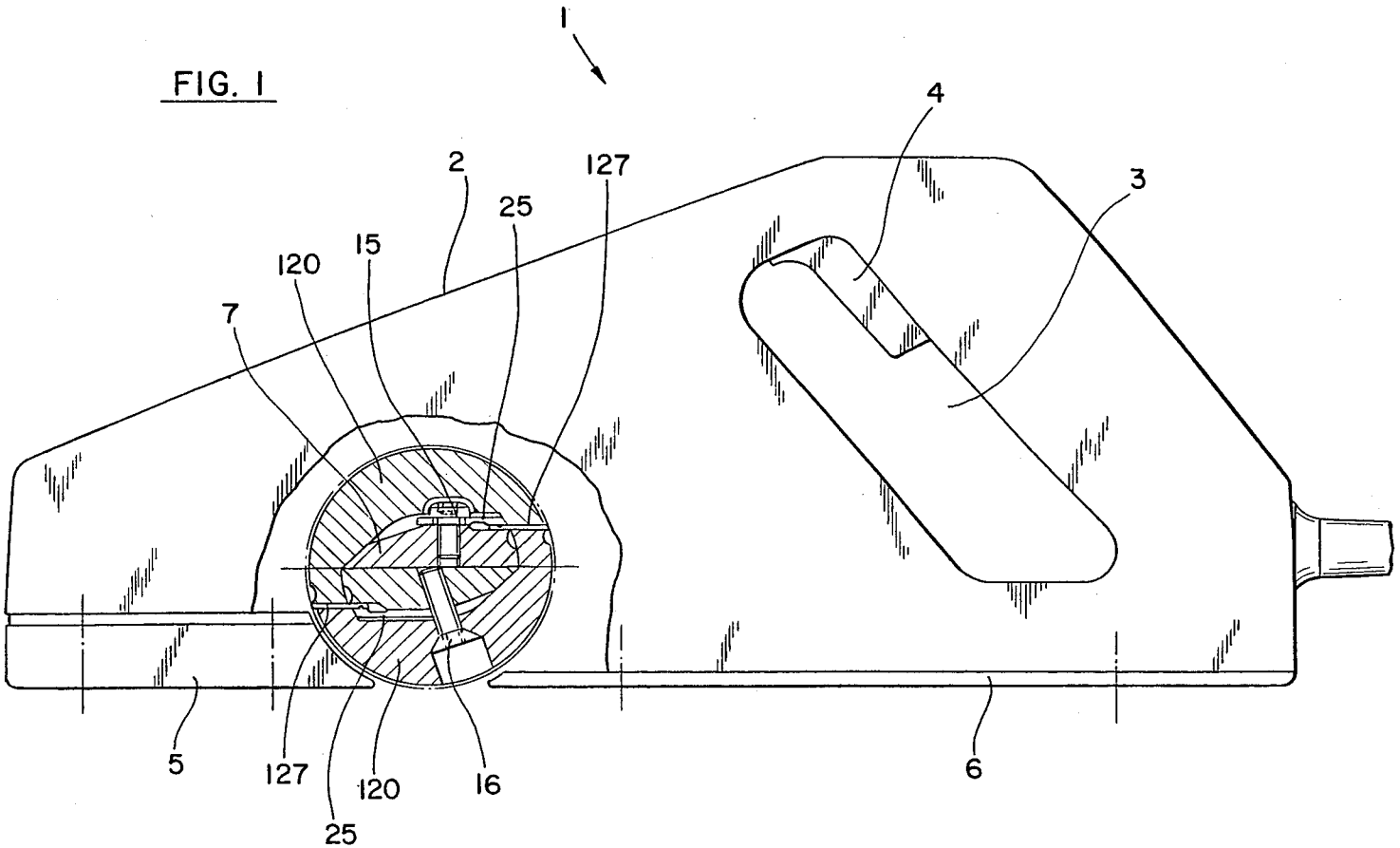
FIG. 1 is a side elevational view of a portable electric planer according to the invention, with a portion broken away and parts so exposed sectioned.

The electric planer 1 shown in FIG. 1 substantially corresponds to the electric planer shown in U.S. Pat. No. 4,347,882 and will consequently not be described in detail here. It has a housing 2 receiving an electric motor, a cutterhead and other components. A rear handle is formed by a gripping opening 3 into which projects a pushbutton 4 of the on-off switch. Shoe plates 5 and 6 are detachably fixed to the underside of housing 2 by means of screws indicated by dot-dash lines. A gap is formed between the shoe plates and into which extends part of the sectionally represented cutterhead. The cutterhead is used for profile planing, in the manner shown in FIGS. 6 to 9. In FIG. 1, the parts located above the horizontal middle plane of the cutterhead are shown in section according to FIG. 7, and those parts located below the horizontal middle plane are shown in section according to FIG. 8. The recess in the housing for receiving the cutterhead is larger than in the case of the electric planer used solely for planing according to U.S. Pat. No. 4,347,882; this enables the recess to receive a cutterhead for normal planing and for profile planing purposes.

Figure 2B:
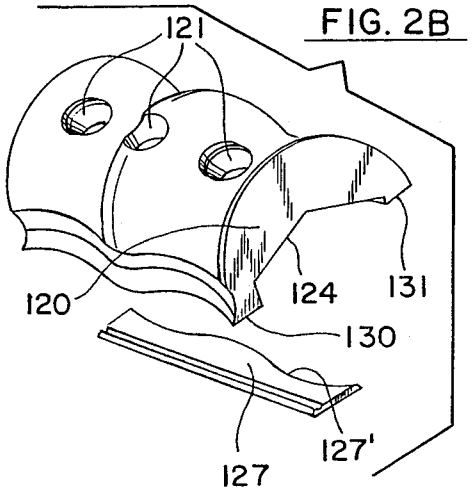
FIG. 2B is an exploded view of two different parts for the cutterhead of FIG. 2A.
Figure 2A:
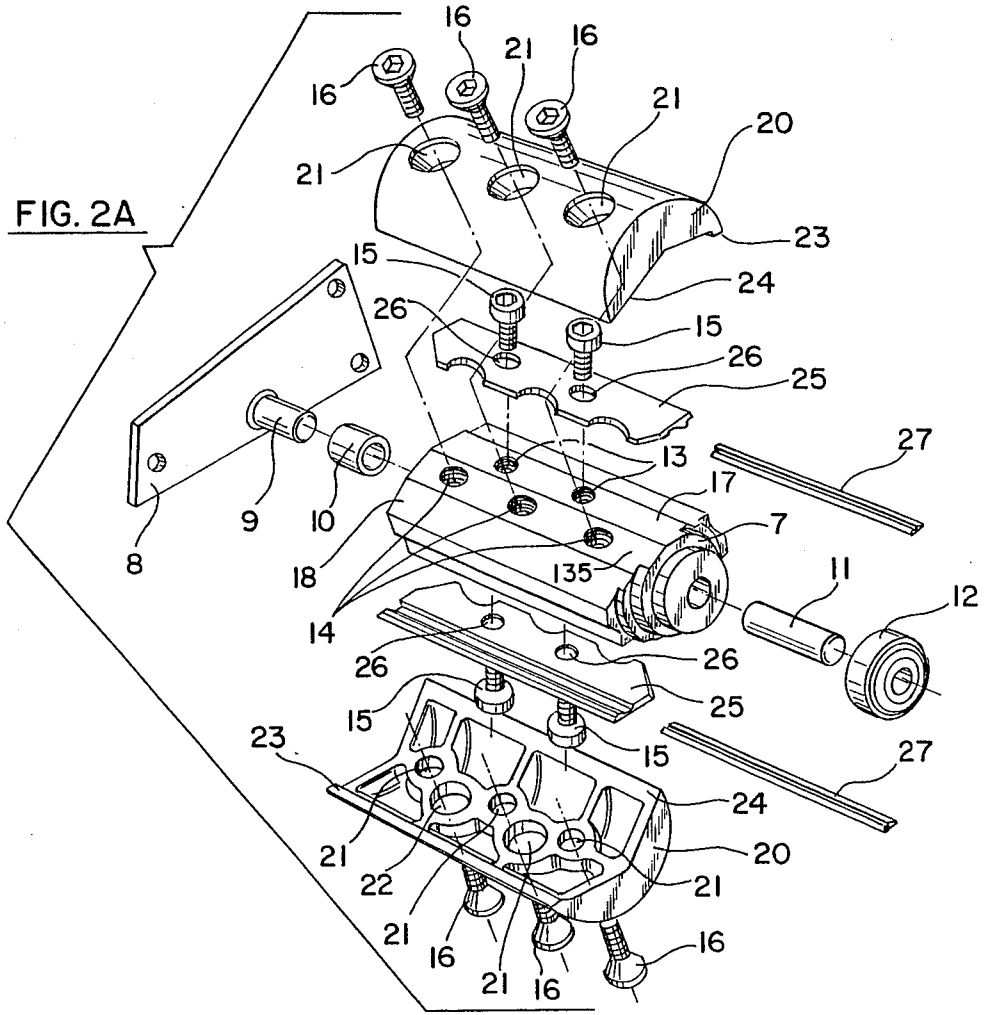
FIG. 2A is an exploded view of a modified cutterhead according to the invention.
Figure 5:
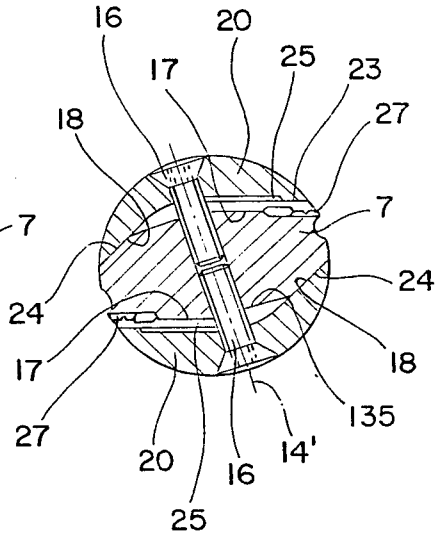
FIG. 5 is a section on the line 5—5 of FIG. 3.
Figure 4:
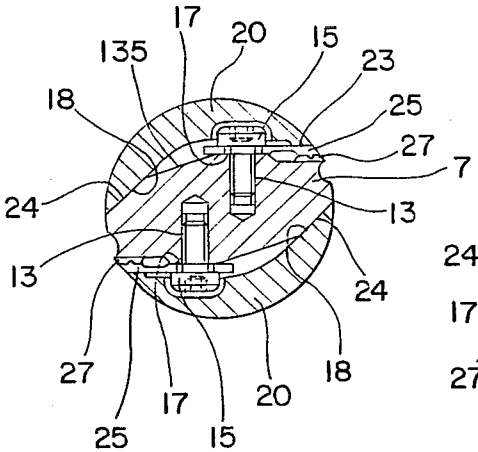
FIG. 4 is a section on the line 4—4 of FIG. 3.
Figure 3:
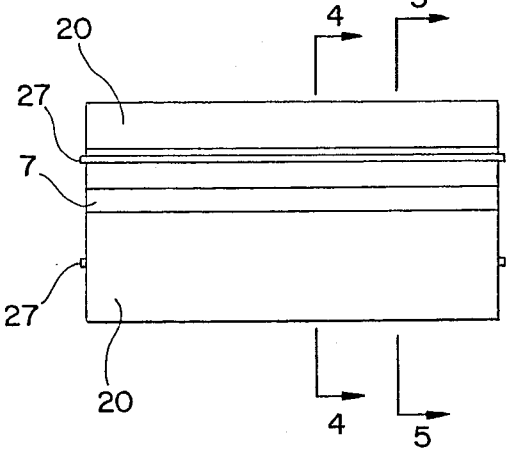
FIG. 3 is a rear elevational view of the cutterhead of FIG. 2A.

A cutterhead for the planer according to FIG. 1 for normal planing purposes is shown in exploded form in FIG. 2A, as well as in FIGS. 3 to 5. This cutterhead has a core 7 which, in much the same way as described in the aforementioned U.S. Patent is mounted for rotation by means of two axial portions 9 and 11, as well as by means of bearings 10 and 12 to a carrier plate 8 at one end, and at the other end to a facing holding plate provided in the housing 2 of electric planer. The plate 8 is laterally fitted to the housing 2 so that it can be removed to effect replacement of the cutterhead or individual parts thereof.

With respect to its central axis of rotation, the core 7 is centrosymmetrical and is provided on diagonally facing sides with an axially extending, planar contact surface 17, as well as circumferentially and spaced therefrom, and also axially directed, planar support surface 18. Contact surface 17 and support surface 18 are at an angle of approximately 225 degrees to one another, as can in particular be gathered from FIGS. 4, 5, 7 and 8. In contact surfaces 17 there are threaded holes 13 into which can be screwed fixing screws 15. These screws 15 pass through bores 26 in pressure plates 25, one on each side of the core 7, in order to secure two cutting blades 27 in clamped manner between the pressure plates 25 and the core 7 when the screws 15 are tightened.

Figure 8:
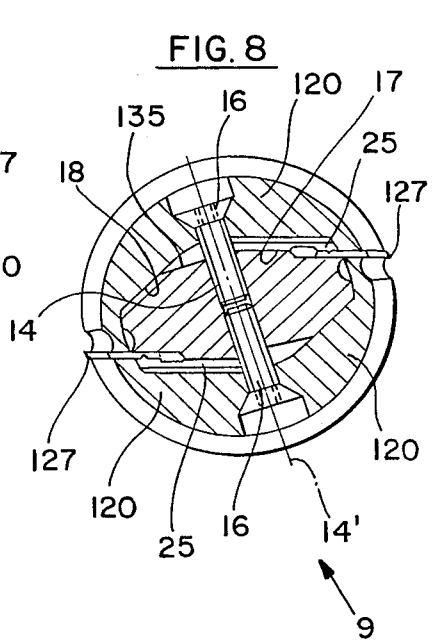
FIG. 8 is a section on the line 8—8 of FIG. 6.

In a transition surface 135 between the contact surface 17 and support surface 18 are provided three threaded holes 14, whose central axes 14' (see FIGS. 5 and 8) are located on the angle bisector of the angle enclosing the particular contact surface 17 with the associated support surface 18 and passing through the central axis of the core 7 (FIGS. 5 and 8). Opposing cover portions 20 are each provided with three bores 21 through which securing screws 16 can be screwed into the threaded holes 14 to secure the cover portions 20 to the core 7. Heads of the pressure plate fixing screws 15 are received and accommodated in recesses 22 in the inner faces of the cover portions 20.

A face 24 of each cover portion 20, used for supporting that cover portion on core 7, makes the same angle to a face 23, which engages the associated pressure plate 25, as the angle the support surface 18 makes to the contact surface 17. Due to this angular disposition of the pair of faces 23 and 24 of each cover portion 20 with respect to one another, on securing the cover portions 20 to the core 7 by means of the screws 16 a pressure force against the core 7 is created, which force is directed towards the central axes 14' of threaded holes 14. As a consequence of the angle of contact surface 17 with respect to support surface 18, this force is subdivided into two components; one of these components is perpendicular to the support surface 18; the other of these components is perpendicular to the upper face of the pressure plate 25 and therefore also to the contact surface 17, as well as to the support surface for the cutting blade 27 which is parallel thereto. Additional force components act radially outwards parallel to contact surface 17 and support surface 18. As a result of this force action, cover portions 20 are aligned and secured in a clearly defined manner on core 7, so that tolerances in the dimensions of screws 16 are compensated for and corrected.

However, the illustrated core 7 of the invention is not only suitable for the construction of a cutterhead for normal planing, but is also suitable for the construction of a cutterhead for profile planing as illustrated in FIGS. 6 to 9.

For the construction of a cutterhead for profile planing, use is made of the same core 7 together with the pressure plates 25 to be fixed by means of screws 15, as shown in FIGS. 2A and 3 to 5. However, differently constructed cover portions 120 are fixed to the core 7 by screws 16, and differently constructed cutting blades 127 are used.

Figure 7:
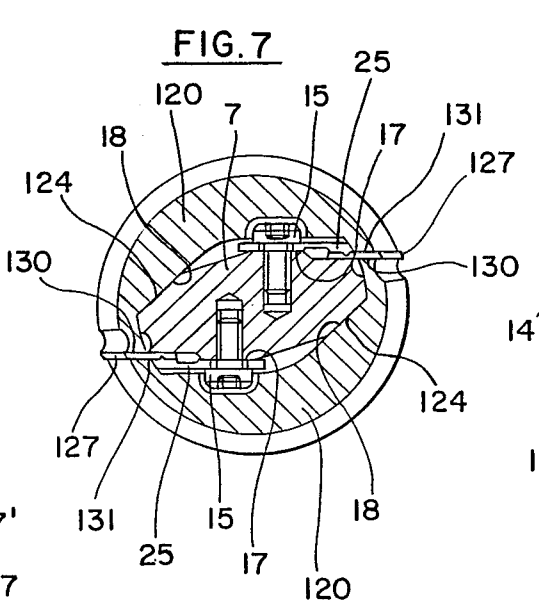
FIG. 7 is a section on the line 7—7 of FIG. 6.
Figure 6:
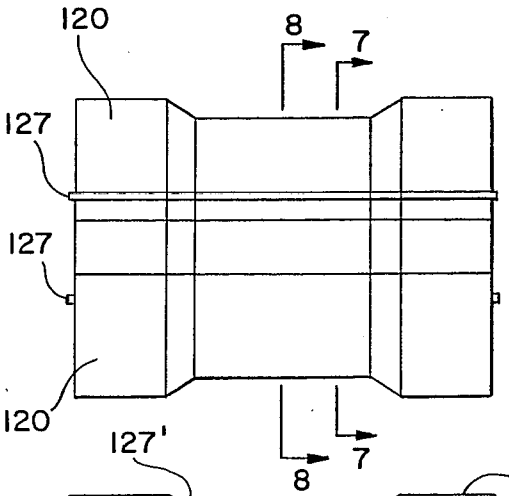
FIG. 6 is a view corresponding to FIG. 3 of the cutterhead of the power planer of FIG. 1.

As can be seen in FIGS. 7 and 8, as well as in FIG. 2B, the cover portions 120 have bores 121 through which can be passed the screws 16 and screwed into the bores 14 of core 7. The dimensions of cover portions 120 are larger than cover portion 20. On the underside of each cover portion 120 is formed a support surface 124, which in the fitted state is at the same angle as support surface 18 of the core 7 and is supported thereon. Adjacent to support surface 124 is provided a support surface 130, which projects with respect to surface 124, and, as will be described hereinafter, engages against the underside of one of the cutting blades 127, which cutting blade is held by the pressure plate 25 covered by the other cover portion 120. On the opposite side of each cover portion 120 there is a support surface 131 which, in the assembled state, rests on the top of the other cutting blade 127, that is the cutting blade held by the pressure plate 25 covered by that cover portion 120.

As can be gathered from FIGS. 7 and 8, firstly the cutting blades 127 are secured by means of the pressure plates 125 and screws 15 to core 7 in the same way as described in conjunction with FIGS. 2A and 3 to 5. However, the cutting blades 127 have a much greater width, and therefore their cutting edges project outwards over the core 7. In order to protect these cutting blades 27 against deformation on the top thereof close to their outer cutting edges engages in each case one of the support surfaces 131, and on the bottom thereof in each case one of the support surfaces 130. Thus each projecting blade edge is supported between opposing support surfaces 130, 131 of the two cover portions 120. Also, when the cover portions are secured in position by the screws 16, the contact surfaces 17 and support surfaces 18 of the core 7, correctly align the cover portions as described in connection with FIGS. 2A and 3 to 5.

In the outer circumference thereof, and adjacent to support surface 130, each cover portion 120 also has an axially directed fillet, which in the assembled state forms a groove adjacent to the cutting edge of the cutting blade. This also applies to the cutterhead of FIGS. 3 to 5 and is disclosed in U.S. Pat. No. 4,347,882.

Figure 9:
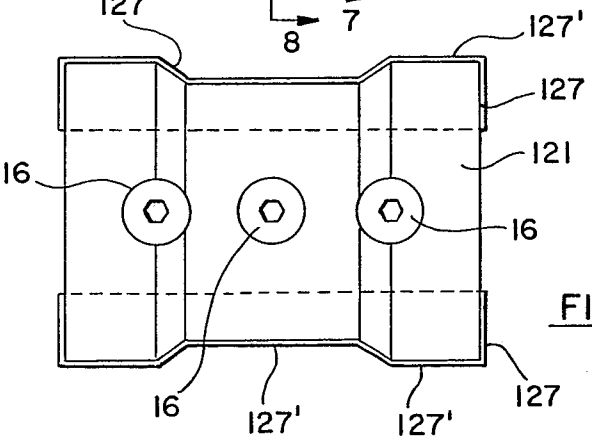
FIG. 9 is a view in the direction of the arrow 9 in FIG. 8 of the cutterhead of FIGS. 6 to 8.

Since the cutting blades 127 project outwards over core 7, the cutting blades 127 can be constructed as profile cutting blades, i.e. have a non-linear cutting edge configuration 127' as illustrated in FIGS. 2B and 9. The outer circumference of the cover portions 12O is then correspondingly shaped, so that it is adapted to the cutting edge configuration 127' and is only at a limited distance from the actual cutting edge. This is clearly shown in FIG. 9.

It should be noted that the cutting edge configuration 127' and the corresponding circumferential shape of cover portions 120 in FIGS. 6 to 9 do not correspond with the cutting edge configuration 127' and the external shape of cover portion 120 in FIG. 2B where a different shape is shown for illustrating the available profiling possibilities.

If a cutterhead according to FIGS. 6 to 9 is inserted in the indicated manner in planer 1 (FIG. 1), it almost completely fills the recess provided in the housing for the cutterhead. In order that the gap width between the gap-limiting edges of shoe plates 5, 6 and the cutterhead does not exceed a minimum value in accordance with the safety regulations, shoe plates 5, 6 adapted to the cutterhead dimensions are mounted to the underside of the housing 2. The gap-limiting edges of the shoe plates 5, 6 are thus provided with a configuration adapted to the cutting edge configuration 127' when a cutterhead with such a cutting edge configuration is inserted.

If the cutterhead shown in FIG. 1 is to be replaced, then plate 8 (FIG. 2A) is merely detached and the cutterhead drawn laterally out of the housing 2 and replaced by another cutterhead, e.g. that according to FIGS. 3 to 5. Additionally, the shoe plates 5, 6 are replaced by shoe plates appropriate for the new cutterhead. However, instead of replacing the whole cutterhead, the same core can be used and on it can be fitted different cutting blades and cover portions.

Figure 10:
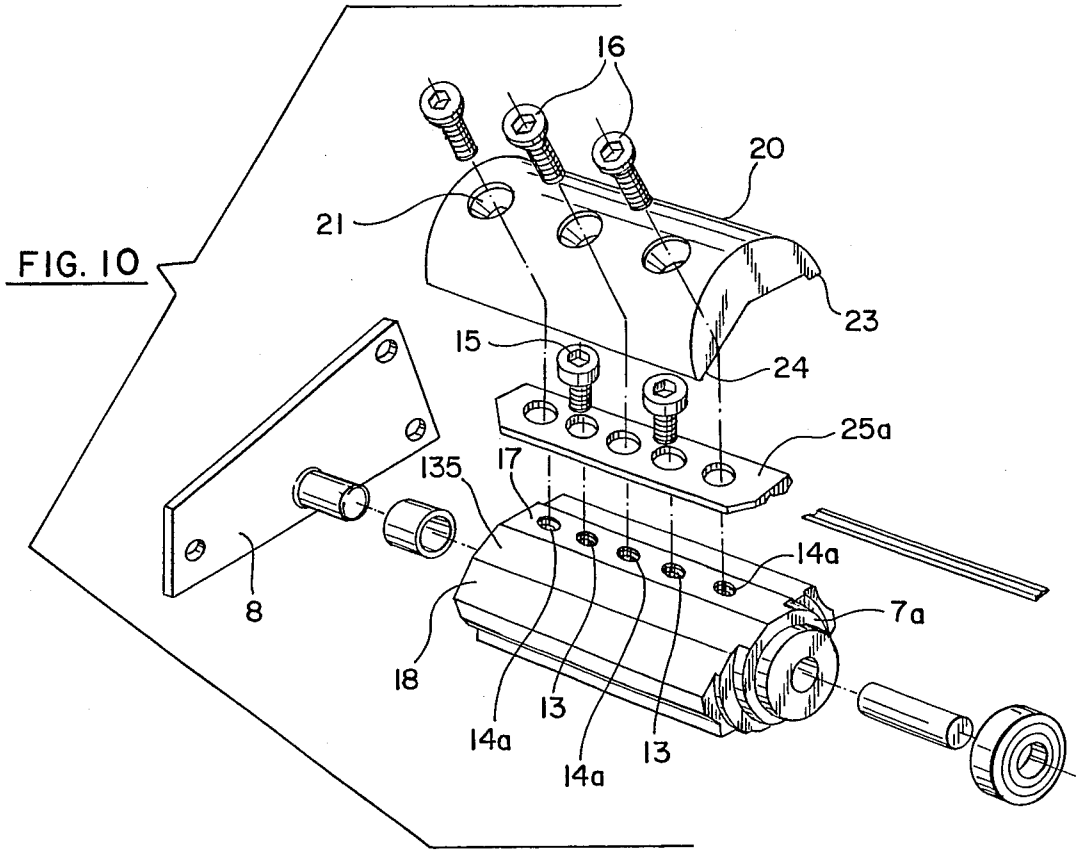
FIG. 10 is an exploded view, similar to the upper portion of FIG. 2A, of some parts of another embodiment of the cutterhead.

FIG. 10 illustrates a modification of the foregoing cutterheads. FIG. 10 is similar to the upper portion of FIG. 2A and only the differences thereto will be described. The threaded holes 14 of FIG. 2A are moved from the transition surface 135 to the contact surface 17 and shown as threaded holes **14*a*. The threaded holes 13 remain in the contact surface 17 and are equally spaced between the holes 14*a*. The pressure plate 25*a* is correspondingly modified to have five through-bores for the three screws 16 as well as the two screws 15. The rest of the cutterhead remains the same, including the angular disposition of the under surfaces 23, 24 of the cover portion 20 and their respective parallel engagement with the angled and spaced apart surfaces 17, 18 of the core 7*a*. This modification is preferred from a manufacturing view point as it considerably facilitates manufacturing of the cutterhead. However, the embodiments of FIGS. 1 to 9** are preferred for overcoming imbalances in the cutterhead when rotating.

The above described embodiments, of course, are not to be construed as limiting the breadth of the present invention. Modifications, and other alternative constructions, will be apparent which are within the spirit and scope of the invention as defined in the appended claims.

What is claimed is:

1. A cutterhead for a power planer, comprising:

an elongated core with threaded holes therein;

at least one pressure plate releasably mounted on said core with a cutting blade clamped between said core and said pressure plate;

at least one cover portion releasably secured by screws to said core, the cover portion being supported by said core and covering said pressure plate;

a support surface provided on said core for said cover portion;

a contact surface provided on said core for said pressure plate; and said support surface being inclined with respect to said contact surface at an angle of more than 180 degrees and less than 270 degrees.

2. The cutterhead of claim 1, wherein said core has threaded holes which receive said screws for mounting said cover portion, said threaded holes having central axes disposed at an angle to said contact surface which is smaller than said angle between said contact surface and said support surface.

3. The cutterhead of claim 2, wherein said angle of said central axes to said contact surface is half the angle between said contact surface and said support surface.

4. The cutterhead of claim 2, wherein said central axes of said threaded holes intersect a central longitudinal axis of said core and about which said core rotates in use.

5. The cutterhead of claim 1, wherein said core is provided with two sets of threaded holes, two contact surfaces for two pressure plates, and two support surfaces for two cover portions arranged symmetrically on diagonally opposite sides of said core.

6. The cutterhead of claim 5, wherein the two cover portions enclose said core and support each cutting blade, respectively, between a pair of opposed outer surfaces of the cover portions.

7. The cutterhead of claim 6, wherein the cutting blades are profile cutting blades, and said cover portions are formed with profiles, in areas adjacent to said cutting blades, corresponding to profiles of said profile cutting blades.

8. The cutterhead of claim 1, wherein said cover portion is supported on said pressure plate in the area of the cutting blade, and another surface of said cover portion spaced from said area is supported on said support surface.

9. A cutterhead for a power planer, comprising:

a core, a pressure plate, a cutting blade and a cover portion;

means for rotatably supporting said core in a power planer for rotation about a central axis of said core;

said core having thereon a support surface for and in contact with said cover portion, a contact surface for and in contact with said pressure plate, and a transition surface between said support surface and said contact surface;

said support surface, said contact surface and said transition surface being spaced from but extending parallel to said central axis;

said cover portion being releasably secured by screws to said core, and said blade being clamped between said core and said pressure plate;

threaded holes in said core and located through said transition surface, said screws being screwed into said threaded holes;

said pressure plate being releasably secured by further screws to said core, said further screws engaging in further threaded holes in said core, said further threaded holes being located through said contact surface; and said support surface being inclined at an angle of more than 180 degrees and less than 270 degress to said contact surface.

10. The cutterhead of claim 9, wherein said angle is 225 degrees.

11. The cutterhead of claim 9, further comprising:

a second similar cover portion; and said blade being supported, adjacent a cutting edge thereof and outwardly of said pressure plate, between a pair of opposed outer surfaces of the two cover portions.

12. The cutterhead of claim 9, wherein said contact surface and said support surface are both inclined at equal angles to said transition surface.

13. A power planer, comprising:

a housing:

a cutterhead having a central longitudinal axis and being mounted in said housing for rotation about said axis;

said cutterhead comprising a core, a pressure plate, a cutting blade and a cover portion;

said pressure plate being releasably mounted on said core with said cutting blade clamped between said core and said pressure plate;

said cover portion being releasably secured by screws to said core and covering said pressure plate;

a support surface on said core and in support contact with said cover portion;

a contact surface on said core and spaced from said support surface by a transition surface, said contact surface contacting said pressure plate; and said support surface being inclined with respect to said contact surface at an angle of more than 180 degrees and less than 270 degrees.

14. The power planer of claim 13, further comprising:

a forward shoe plate releasably connected to said housing;

a rearward shoe plate releasably connected to said housing; and a slot defined between edges of said shoe plates and through which slot a peripheral portion of said cutterhead is exposed.

15. The power planer of claim 14, wherein said cutting blade is a profiled cutting blade with a profiled cutting edge, and said edges of said shoe plates are profiled to correspond with said profiled cutting edge.

16. The power planer of claim 14, wherein said angle is in the range of 200 degrees to 250 degrees.

17. The power planer of claim 13, wherein said angle is 225 degrees.

* * * * *